US006514653B1

(12) United States Patent
Tavernier et al.

(10) Patent No.: US 6,514,653 B1
(45) Date of Patent: Feb. 4, 2003

(54) ELECTROSTATICALLY AND/OR MAGNETICALLY ATTRACTABLE TONER POWDER

(75) Inventors: Serge Tavernier, Lint (BE); Werner Op De Beeck, Keerbergen (BE); Jean-Pierre Ghekiere, Lint (BE); Michel Vervoort, Antwerp (BE)

(73) Assignee: Xeikon NV (BE)

( * ) Notice: Subject to any disclaimer, the term of this patent is extended or adjusted under 35 U.S.C. 154(b) by 0 days.

(21) Appl. No.: 08/628,281

(22) Filed: Apr. 5, 1996

Related U.S. Application Data

(63) Continuation-in-part of application No. 08/347,453, filed on Dec. 6, 1994, now abandoned.

(30) Foreign Application Priority Data

Jun. 2, 1993 (EP) ..... 93201815
May 30, 1994 (WO) ..... PCT/EP94/01772

(51) Int. Cl.[7] ..... G03G 9/087
(52) U.S. Cl. ..... 430/109.4; 430/109.3; 430/111.4
(58) Field of Search ..... 430/110, 109, 430/109.3, 109.4

(56) References Cited

U.S. PATENT DOCUMENTS 3,775,115 A * 11/1973 Sorkin et al. ..... 430/124
4,837,138 A * 6/1989 Horie ..... 430/109
5,173,387 A * 12/1992 Niki et al. ..... 430/109
5,234,787 A * 8/1993 Morimoto et al. ..... 430/109
5,314,777 A * 5/1994 Watanabe et al. ..... 430/110

OTHER PUBLICATIONS

L.H. Sperling, "Introduction to Physical Polymer Science", Wiley–Interscience, New York, p. 111, (1986).

* cited by examiner

*Primary Examiner*—Christopher Rodee
(74) *Attorney, Agent, or Firm*—Knobbe, Martens, Olson & Bear, LLP

(57) ABSTRACT

Dry toner particles are provided wherein the toner resin includes a mixture of two polymer A and B, A and B being chosen such that an extruded slab with thickness 250 $\mu$m of a 50:50 mixture of both has a transmission density ($D_M$) being between 0.10 and 1.00 higher than the sum of half the transmission density of a 250 $\mu$m extruded slab of polymer A alone ($D_A$) and half the transmission density of a 250 $\mu$m extruded slab of polymer B alone ($D_B$). The polymers A and B are mixed in a weight ratio between 5:1 to 1:5 and make up at least 25% by weight of the total toner resin. The polymer A is a polyester and the polymer B is a polyester or a specified styrene-acrylic copolymer.

13 Claims, No Drawings

ELECTROSTATICALLY AND/OR MAGNETICALLY ATTRACTABLE TONER POWDER

This is a continuation in part of U.S. Ser. No. 08/347,453 filed on Dec. 6, 1994, which is now abandoned.

FIELD OF THE INVENTION

The present invention relates to a toner composition suited for development of electrostatic charge images or magnetic patterns.

BACKGROUND OF THE INVENTION

It is well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas (plasma) onto a dielectric substrate.

The obtained latent images are developed, i.e. converted into visible images by selectively depositing thereon light absorbing particles, called toner particles, which usually are triboelectrically charged.

In magnetography a latent magnetic image is formed in a magnetizable substrate by a patternwise modulated magnetic field. The magnetizable substrate must accept and hold the magnetic field pattern required for toner development which proceeds with magnetically attractable toner particles.

In toner development of latent electrostatic images two techniques have been applied: "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511.

In DEP (Direct Electrostatic Printing) toner particles or are deposited directly in an imagewise way on a receiving member substrate, the latter not bearing any imagewise latent electrostatic image. Preferentially the receiving member substrate is the final receiving member substrate, e.g. plain paper, transparency, etc. so that after this deposition step only a final fusing step is needed to finish the printout.

The visible image of electrostatically or magnetically attracted toner particles is not permanent and has to be fixed by causing the toner particles to adhere to the final substrate by softening or fusing them followed by cooling. Normally fixing proceeds on more or less porous paper by causing or forcing the softened or fused toner mass to penetrate into the surface irregularities of the paper.

Dry-development toners essentially comprise a thermoplastic binder consisting of a thermoplastic resin or mixture of resins (ref. e.g. U.S. Pat. No. 4,271,249) including colouring matter, e.g. carbon black or finely dispersed dye pigments. The triboelectrically chargeability is defined by said substances and may be modified with a charge controlling agent.

In the low density parts of toner-developed prints the toner particles are deposited at low coverage and do not form a closed or solid deposit of black or coloured material. On the contrary, in the high density portions toner particles are piled on each other and co-fused to form a closed toner-crust which optically has a quite different look as the separately fixed toner particles in the low density portions. Separately deposited and fixed toner particles or small clusters thereof give rise to a light-straying effect. In particular by inspecting the copy with light directed thereto at small grazing angle the small density parts show a mat (dull) appearance. On the contrary, in the high density parts containing smooth coherently co-fused toner particles light is reflected by the glossy surface of the toner crust; whereby light-reflection stands in relation to the kind of binder which normally is a relatively hard thermoplastic transparent resin or mixture of resins.

There are different types of processes used for fusing a toner powder image to its final substrate. Some are based upon fixation primarily on fusing by heat, others are based on softening by solvent vapours, or by the application of cold flow at high pressure in ambient conditions of temperature. In the fusing processes based on heat, two major types should be considered, the "non-contact" fusing process and the "contact" fusing process. In the non-contact fusing process there is no direct contact of the toner image with a solid heating body. Such process includes: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp. In said "radiant" non-contact fusing embodiment radiation such as infrared radiation may be at least partly absorbed in the final support and therefrom by conduction transferred to the thereon deposited toner image(s).

According to a particular embodiment of "non-contact" fusing the heat reaches the non-fixed toner image through its substrate by contacting the support at its side remote from the toner image with a hot body, e.g. hot metallic roller.

Non-contact fusing has the advantage that the non-fixed toner image does not undergo any mechanical distortion and fine image details will not suffer from transfer to a contacting fixing member, by so-called "offset" phenomena typical for hot pressure roller fusing.

In an embodiment of common "contact" fusing the support carrying the non-fixed toner image is conveyed through the nip formed by a heating roller also called fuser roller and another roller backing the support and functioning as pressure exerting roller, called pressure roller. This roller may be heated to some extent so as to avoid strong loss of heat within the copying cycle.

In producing halftone, i.e. screened images, toner-contacting pressure fuser rollers can distort the dot structure of the screened images. Such will be particularly the case when the pressure-fuser roller has no perfect smooth structure and textures the obtained image.

Whatever the kind of fixing system the above described phenomenon of unequal gloss between low density parts and high density parts will arise, especially when the final print is on a glossy support.

It is desirable to have of a toner available which on fixing will give an equal not very glossy aspect whatsoever the optical density of the image parts will be. Fixed toner images having a satin-look are preferred for they give a better legibility in text parts and provide a nice image aspect.

OBJECTS AND SUMMARY OF THE INVENTION

It is an object of the present invention to provide dry toner particles wherein the composition of the toner particles is such that the fixed toner image, independent of its optical density, has the same or almost the same reflection properties.

It is more particularly an object of the present invention to provide dry toner particles that, after fixing to a final substrate, form a fixed toner image with a satin-look, without use of special covering layers for controlling reflection properties.

It is more particularly an object of the present invention to provide such dry toner particles suited for being fixed to a substrate by non-contact fusing by moderate heating.

Other objects and advantages of the present invention will appear from the further description.

In accordance with the present invention dry toner particles are provided said toner particles comprising a toner resin, wherein:

(i) said toner resin includes a mixture of two polymers (A and B), said polymers A and B being chosen such that an extruded slab with thickness 250 $\mu$m of a 50:50 mixture of both has a transmission density ($D_M$) being between 0.10 and 1.00 higher than the sum of half the transmission density of a 250 $\mu$m extruded slab of polymer A alone ($D_A$) and half the transmission density of a 250 $\mu$m extruded slab of polymer B alone ($D_B$), (ii) said polymer A being a polyester and said polymer B being a polyester or a styrene-acrylic copolymer, said styrene-acrylic copolymer having a styrene content of more than 70 mol % and a weight average molecular weight ($M_W$) such that $7{,}000<M_W<50{,}000$, (iii) said polymers A and B, included in said toner resin, are mixed in a weight ratio 5:1 to 1:5 and (iv) said mixture of said two polymers A and B makes up at least 25% by weight of said toner resin.

In a preferred embodiment said mixture of said two polymers (A and B) is a 50:50 mixture by weight.

In a more preferred embodiment said mixture of said two polymers A and B makes up at least 75% by weight of said toner resin.

In a most preferred embodiment, toner resin consists of a mixture of said two polymers A and B.

DETAILED DESCRIPTION OF THE INVENTION

It has been found that a heat-fixed toner image (produced by classical electro(photo)graphy, magnetography, ionography, direct electrostatic printing, etc), having a satin-look and a gloss that is independent of the optical density in the image, could easily be obtained when the toner particles included a mixture of two resins.

It has been found experimentally that a proper fusing is necessary to obtain the desired satin-look effect. When the fusing is poor, the toner images independently of their coverage have an overall mat aspect since the toner particles largely remain separate and not co-fused. Further, by the fact that individual toner particles are insufficiently co-fused and not coalesced colour mixing is poor. The application of heat in excess will result in a good co-fusing of the individual toner particles and gives smooth glossy toner images but such at the expense of image resolution (line spread) and excessive dot gain in halftone (screened) images.

Best results with regard to satin-look are obtained when said mixture of said two resins (polymers) is made from polymers that are almost compatible in the molten state and by means of which no substantial phase separation takes place. Phase separation may have a deteriorating effect on cohesiveness and will give rise to the production of toner particles with inhomogeneous character and different electrostatic properties.

So, it is preferred that said two polymers do not disturb an even distribution of the other toner ingredients such as colouring matter, charge controlling agents, flowing agents, etc.

A good satin-look could be obtained, when the toner particles comprised a toner resin wherein a mixture of two polymers (A and B), said mixture showed a ratio A/B between 5:1 and 1:5 and said mixture made up at least 25% by weight of said toner resin. It was however found that said satin-look could not be obtained by mixing whichever pair of polymers in the ratio mentioned above and adding at least 25% by weight of said mixture to the toner resin. The desired satin-look could only be obtained when said polymers A and B were chosen such that an extruded slab with thickness 250 $\mu$m of a 50:50 mixture of both has a transmission density ($D_M$) being between 0.10 and 1.00 higher than the sum of half the transmission densities of a 250 $\mu$m extruded slab of polymer A alone ($D_A$) and half the transmission density of a 250 $\mu$m extruded slab of polymer B alone ($D_B$).

The transmission densities mentioned above are measured as follows: Both resins A and B are pulverized to a particle size smaller than 1 mm. These powders are mixed in a 50:50 ratio by weight. The powder mixture is fed to a single shaft screw-extruder of bore diameter 19 mm and length 25 times said diameter. The extruder is heated in such a way that the temperature of the extruded product is between 100 and 120° C. at 50 screw revolutions per minute and the molten product is extruded through a slit to form a ribbon having a thickness of about 500 $\mu$m. A part of that ribbon is put on a microscope glass carrier plate and conditioned thereon for 10 minutes at 145° C. After cooling a slab of the polymer mixture of about 250 $\mu$m thick is formed. The transmission density of this slab ($D_M$) is determined by means of a double beam spectrophotometer type ACTA CIII (tradename of BECKMAN Instruments, Inc., Fullerton, Calif. 92634 U.S.A.) operating with light of 540 nm. In a similar way slabs of about 250 $\mu$m of the single polymers A and B are obtained and the transmission density measured ($D_A$ and $D_B$). All densities were then normalized to a slab thickness of 250 $\mu$m. With the values obtained by these measurements the difference ($D_{excess}$) between $D_M$ and ($D_A/2+D_B/2$) is calculated. It was found that including the mixture of A and B in the toner resin only give a fixed image with a satin-look and wherein the gloss is independent of the optical density (i.e. the amount of deposited toner particles) of the image when $0.10 \leqq D_{excess} \leqq 1.00$.

Preferably $0.3 \leqq D_{excess} \leqq 0.7$. When $D_{excess}$ exceeds 1.0 the incompatibility of both polymers begins to pose serious problems in that the toner composition becomes too strongly inhomogeneous.

In preferred dry toner particles according to the present invention said weight ratio range A/B is 3:1 to 1:3.

In more preferred embodiment said weight ratio is 50:50.

Although the beneficial effect is already obtained when the toner resin of toner particles, according to the present invention, include for 25% by weight of said mixture of two polymers, it is preferred that said toner resin comprises at least 75% by weight of said mixture of two polymers. The most preferred toner particles, according to the present invention are those wherein the toner resin consists of the said mixture of polymers A and B.

When toner particles, wherein the toner resin consists of the said mixture of polymers A and B are intended for use in non-contact fusing said two polymers, acting as binder in the toner, have both preferably a glass transition temperature (Tg) larger than 45° C., and preferably a melt viscosity smaller than 10,000 poise (1000 Pas) at 120° C. as determined by Test V described furtheron.

The desired effect of satin-look of fused and solidified toner may be obtained by mixing polymers being selected in such a way that they have slight incompatibility with respect to each other. The HILDEBRAND parameter solubility for polymers is described in the book "Properties of Polymers" by D. W. Van Krevelen, 2nd. ed., Elseviers Scientific Publishing Company, New York, 1976, Chapter 7.

In general the desired slight incompatibility can be obtained by combining a thermoplastic resin, e.g. a polyester, with a resin having a more polar character than said thermoplastic resin. By more polar character is meant possessing a higher dielectric constant and/or better wettability by water. For example, a water-insoluble polyester combined with a resin including ether units such as ethylene oxide units or amino units such as dialkyl-amino units can give a mixture of polymers A and B fulfilling the demands on $D_{excess}$.

In preferred dry toner particles according to the present invention said mixture of polymers A and B comprises a polyester.

The other polymer to be mixed with said polyester and that fulfils the requirement of slight incompatibility giving rise to the desired satin-look in the fused and thereupon solidified state can also be a polyester.

In a preferred embodiment of the invention, said mixture of polymers A and B is a mixture of two polyesters: a polyester resin (polyester P1) with low (less than 5.5 mol/kg) carbonyloxy group (—CO.O—) content (the carbonyloxy groups are part of the ester groups), being preferably derived from a non-aromatic dicarboxylic acid, e.g. fumaric acid and an ethoxylated and/or propoxylated Bisphenol A, and a second polyester resin (polyester P2) being a polyester with high (at least 7.5 mol/kg) carbonyloxy group content, being preferably a polyester derived from an aromatic dicarboxylic acid and a diol. The latter polyester (polyester P2) is preferably derived from terephthalic acid and isophthalic acid, or mixtures thereof. In the production of said polyester P2 the diol is preferably ethylene glycol optionally mixed with DIANOL 22 and DIANOL 33 as long as the ethylene glycol content of the totality of diols is more than 50 mol %, preferably at least 60 mol %. A linear polyester of fumaric acid and DIANOL 33 is marketed under the tradename ATLAC T500 (Tg=50.5° C.) (ATLAC is a registered trade name of Atlas Chemical Industries Inc. Wilmington, Del. U.S.A.). This polyester is a preferred polyester of the P1 type.

DIANOL 22 is di-ethoxylated Bisphenol A.

DIANOL 33 is di-propoxylated Bisphenol A.

Bisphenol A=4,4' isopropylidenediphenol.

Polyester resins suitable for use according to the present invention are selected e.g. from the group of linear polycondensation products of (i) difunctional organic acids, e.g. maleic acid, fumaric acid, terephthalic acid and isophthalic acid and (ii) difunctional alcohols (diol) such as ethylene glycol, triethylene glycol, an aromatic dihydroxy compound, preferably a bisphenol such as 2,2-bis(4-hydroxyphenyl)-propane called "Bisphenol A" or an alkoxylated bisphenol, e.g. propoxylated bisphenol examples of which are given in U.S. Pat. No. 4,331,755. For the preparation of suitable polyester resins reference is made to GB-P 1,373,220.

A particularly suitable polyester is a linear polyester of fumaric acid and di-propoxylated bisphenol A, having a melt viscosity of 1800 poise (180 Pas) and a Tg of about 50° C.

Good satin-look results are obtained likewise when said mixture of polymer A and B comprises a polyester (polymer A) in combination with a styrene-acrylic resin (polymer B) having a relatively high (more than 70 mol %) styrene content, more particularly copolymers of styrene-acrylic resins or styrene-methacrylic resins, e.g. copoly(styrene/n-butylmethacrylate) or copoly(styrene/2-ethylhexylacrylate). Styrene-acrylic polymers, useful in toner particles according to the present invention, have preferably a weight-average molecular weight between 7,000 and 50,000 and a melt viscosity lower than 10,000 poise (1000 Pas).

Good satin-look in the finished, fixed image was also obtained when, instead of polyesters, polymers wherein the above mentioned carbonyloxy groups are wholly or partly replaced by carbonylimine (—CO.NH—) groups were used.

The glass transition temperature (Tg) mentioned herein is determined according to ASTM Designation: D 3418-82.

The melt viscosity mentioned herein is determined by the following test V.

TEST V

For determining the melt viscosity of the selected sample a RHEOMETRICS dynamic rheometer, RVEM-200 (One Possumtown Road, Piscataway, N.J. 08854 USA) is used. The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians. Before recording the measurement signals which are expressed in poise (P) or Pascal.second (Pas) the sample is allowed to attain thermal equilibrium for 10 minutes.

Examples of resins, to be mixed together in order to be included in the toner resin of toner particles according to the present invention are listed in the following Table 1, mentioning their glass transition temperature (Tg), melt viscosity, weight-average molecular weight (Mw), number-average molecular weight (Mn), and for the polyesters the carbonyloxy content (CC) expressed in (mol/kg).

TABLE 1

| N° | Polymer | Tg ° C. | Meltvisco poise | $M_w$ | $M_n$ | CC mol/kg |
|---|---|---|---|---|---|---|
| 1 | Polyester P1 | 50.5 | 1,800 | 14,000 | 4,500 | 4.88 |
| 2 | Polyester P2 | 65 | 5,500 | 11,500 | 3,700 | 7.19 |
| 3 | Polyester P3 | 63 | 7,000 | 16,000 | 3,500 | 8.33 |
| 4 | Polyester P4 | 69 | 16,000 | 25,500 | 7,100 | 13.89 |
| 5 | Styr/acryl S1 | 67 | 17,000 | 33,000 | 13,000 | — |
| 6 | Styr/acryl S2 | 68 | 2,850 | 6,500 | 2,000 | — |
| 7 | Styr/acryl S3 | 78 | 1,698 | 19,000 | 7,000 | — |
| 8 | Styr/acryl S4 | 79 | 2,910 | 24,000 | 9,000 | — |
| 9 | Styr/acryl S5 | 79.5 | 6,979 | 36,000 | 13,500 | — |
| 10 | Styr/acryl S6 | 79 | 22,525 | 60,500 | 23,000 | — |

Polyester P1 is ATLAC T500 (tradename).

Polyester P2 is an aromatic polyester resin derived from terephthalic acid (100 mol %) as aromatic diacid and a mixture of DIANOL 33 (50 mol %) and ethylene glycol (50 mol %) as diols.

Polyester P3 is an aromatic polyester resin derived from terephthalic acid (40 mol %), isophthalic acid (60 mol %) as aromatic di-acids and a mixture of DIANOL 22 (40 mol %) and ethylene (60 mol %).

Polyester P4 is an aromatic polyester resin derived from terepthalic acid (64 mol %), isophthalic acid (36 mol %) as aromatic di-acids and ethylene glycol (100 mol %).

Styr/acryl S1 is a copolymer of styrene and methyl acrylate in a 65/35 molar ratio.

Styr/acryl S2 is a terpolymer of styrene, methyl acrylate and dimethylaminoethyl methacrylate in a 87/3/10 molar ratio.

Styr/cryl S3, S4, S5 and S6 are a copolymer of styrene and methyl acrylate in a 80/20 molar ratio, only differing in molecular weight.

0:50 mixtures of polymers from table 1 were made and the $D_{excess}$ determined as described herein above. The results are summarized in table 2.

TABLE 2

| Mixture | First polymer | Second polymer | Smooth** | $D_{excess}$ |
|---|---|---|---|---|
| 1 | Polyester P1 | Polyester P3 | 1 | 0.50* |
| 2 | Polyester P1 | Polyester P4 | 1 | 0.53* |
| 3 | Polyester P1 | Polyester P2 | 1 | 0.017 |
| 4 | Polyester P1 | Styr/acryl S2 | 1 | 0.57* |
| 5 | Polyester P1 | Styr/acryl S1 | 1 | 0.019 |
| 6 | Polyester P1 | Styr/acryl S3 | 1 | 0.44* |
| 7 | Polyester P1 | Styr/acryl S4 | 1 | 0.65* |
| 8 | Polyester P1 | Styr/acryl S5 | 1 | 0.55* |
| 9 | Polyester P1 | Styr/acryl S6 | 2 | 0.43 |
| 10 | Polyester P3 | Styr/acryl S3 | 1 | 0.38* |
| 11 | Polyester P3 | Styr/acryl S4 | 1 | 0.48* |
| 12 | Polyester P3 | Styr/acryl S5 | 1 | 0.73* |
| 13 | Polyester P3 | Styr/acryl S6 | 3 | 0.53 |

**smoothness of a fixed layer (0.5 mg/cm$^2$) of toner particles prepared with the mixture of resins. For the preparation of the toners, see the example below, under preparation of toner III.
*these mixtures are within the scope of the present invention.

Although the mixture 9 and 13 are within the scope of the invention with respect to $D_{excess}$, the smoothness of a fixed layer of toner is unsatisfactory. From the results above, it is clear that not all mixtures of polyesters are within the scope of the present invention and that only those styrene/acryl polymers having a styrene content>70% by weight and a weight-average molecular weight between 10,000 and 50,000 are useful to be mixed with polyesters, giving mixtures within the scope of the invention.

For producing visible images the toner powder contains in the resinous binder a colorant which may be black or having a colour of the visibe spectrum, not excluding however the presence of mixtures of colorants to produce black or a particular colour.

In the preparation of coloured toner particles a resin blend as defined herein is mixed with said colouring matter which may be dispersed in said blend or dissolved therein forming a solid solution.

In black-and-white copying the colorant is usually an inorganic pigment which is preferably carbon black, but is likewise e.g. black iron (III) oxide. Inorganic coloured pigments are e.g. copper (II) oxide and chromium (III) oxide powder, milori blue, ultramarine cobaltblue and barium permanganate.

Examples of carbon black are lamp black, channel black and furnace black e.g. SPEZIALSCHWARZ IV (trade name of Degussa Frankfurt/M-Germany) and VULCAN XC 72 and CABOT REGAL 400 (trade names of Cabot Corp. High Street 125, Boston, U.S.A.).

The characteristics of a preferred carbon black are listed in the following Table 3.

TABLE 3

| | |
|---|---|
| origin | furnace black |
| density | 1.8 g × cm$^{-3}$ |
| grain size before entering the toner | 25 nm |
| oil number (g of linseed oil adsorbed by 100 g of pigment | 70 |
| specific surface (sq.m per g) | 96 |
| volatile material (% by weight) | 2.5 |
| pH | 4.5 |
| colour | black |

In order to obtain toner particles having magnetic properties a magnetic or magnetizable material in finely divided state is added during the toner production.

Materials suitable for said use are e.g. magnetizable metals including iron, cobalt, nickel and various magnetizable oxides, e.g. haematite ($Fe_2O_3$), magnetite ($Fe_3O_4$), $CrO_2$ and magnetic ferrites, e.g. these derived from zinc, cadmium, barium and manganese. Likewise may be used various magnetic alloys, e.g. permalloys and alloys of cobalt-phosphors, cobalt-nickel and the like or mixtures of these.

Toners for the production of colour images may contain organic colorants that may be dyes soluble in the binder resin or pigments including mixtures thereof. Particularly useful organic colorants are selected from the group consisting of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York, U.S.A (1950).

Likewise may be used the dyestuffs described in the following published European patent applications (EP-A) 0 384 040, 0 393 252, 0 400 706, 0 384 990, and 0 394 563.

Examples of particularly suited organic dyes are listed according to their colour yellow, magenta or cyan and are identified by name and Colour Index number (C.I. number) in the following Table 4 which also refers to the manufacturer.

TABLE 4

| | Colour Index 1 and 2 | | Manufacturer |
|---|---|---|---|
| Yellow dye | | | |
| Permanent Yellow GR | PY 13 | 21100 | Hoechst AG |
| Permanent Yellow GG02 | PY 17 | 21105 | " |
| Novoperm Yellow FGL | PY 97 | 11767 | " |
| Permanent Yellow GGR | PY 106 | | " |
| Permanent Yellow GRY80 | PY 174 | | " |
| Sicoechtgelb D1155 | PY 185 | | BASF |
| Sicoechtgelb D1350DD | PY 13 | 21100 | " |
| Sicoechtgelb D1351 | PY 13 | 21100 | " |
| Sicoechtgelb D1355DD | PY 13 | 21100 | " |
| Magenta dye | | | |
| Permanent Rubin LGB | PR57:1 | 15850:1 | Hoechst AG |
| Hostaperm Pink E | PR122 | 73915 | " |
| Permanent Rubin E02 | PR122 | 73915 | " |
| Permanent Carmijn FBB02 | PR146 | 12433 | " |
| Lithol Rubin D4560 | PR57:1 | 15850:1 | BASF |
| Lithol Rubin D4580 | PR57:1 | 15850:1 | " |
| Lithol Rubin D4650 | PR57:1 | 15850:1 | " |
| Fanal Rosa D4830 | PR81 | 45160:1 | " |
| Cyan dye | | | |
| Hostaperm Blue B26B | PB15:3 | 74160 1 | Hoechst AG |
| Heliogen Blau D7070DD | PB15:3 | 74160 | BASF |

TABLE 4-continued

| | Colour Index 1 and 2 | | Manufacturer |
|---|---|---|---|
| Heliogen Blau D7072DD | PB15:3 | 74160 | BASF |
| Heliogen Blau D7084DD | PB15:3 | 74160 | " |
| Heliogen Blau D7086DD | PB15:3 | 74160 | " |

In order to obtain toner particles with sufficient optical density in the spectral absorption region of the colorant, the colorant is preferably present therein in an amount of at least 1% by weight with respect to the total toner composition, more preferably in an amount of 1 to 10% by weight.

Black toner particles according to the present invention for use in fixing by infrared radiant units have preferably a melt viscosity of the powder mass (as defined by test V herein) lower than 7000 P (700 Pas). Colourless toners for use in said fixing unit have preferably a melt viscosity not exceeding 2500 P (250 Pas), and colour toners depending on their radiation absorption have preferably a melt viscosity between 7000 and 3000 P (between 700 and 300 Pas).

In order to modify or improve the triboelectric chargeability in either negative or positive direction the toner particles may contain (a) charge control agent(s). For example, in published German patent application (DE-OS) 3,022,333 charge control agents for yielding negatively chargeable toners are described. In DE-OS 2,362,410 and U.S. Pat. Nos. 4,263,389 and 4,264,702 charge control agents for positive chargeability are described. Very useful charge controlling agents for providing a net positive charge to the toner particles are described in U.S. Pat. No. 4,525,445, more particularly BONTRON NO4 (trade name of Oriental Chemical Industries-Japan) being a nigrosine dye base neutralized with acid to form a nigrosine salt, which is used e.g. in an amount up to 5% by weight with respect to the toner particle composition. A charge control agent suitable for use in colourless or coloured toner particles is zinc benzoate and reference therefor is made to published European patent Application 0 463 876 describing zinc benzoate compounds as charge controlling agents. Such charge controlling agent may be present in an amount up to 5% by weight with respect to the toner particle composition.

In order to improve the flowability of the toner particles spacing particles may be incorporated therein. Said spacing particles are embedded in the surface of the toner particles or protruding therefrom. These flow improving additives are preferably extremely finely divided inorganic or organic materials the primary (i.e. non-clustered) particle size of which is less than 50 nm. Widely used in this context are fumed inorganic particles of the metal oxide class, e.g. selected from the group consisting of silica ($SiO_2$), alumina ($Al_2O_3$), zirconium oxide and titanium dioxide or mixed oxides thereof which have a hydrophillic or hydrophobized surface.

Fumed metal oxides are prepared by high-temperature hydrolysis of the corresponding vaporizable chlorides according to the following reaction scheme illustrative for the preparation of fumed $Al_2O_3$:

$$4\ AlCl_3+6\ H_2+3\ O_2 \longrightarrow 2\ Al_2O_3+12\ HCl$$

The fumed metal oxide particles have a smooth, substantially spherical surface and before being incorporated in the toner mass are preferably coated with a hydrophobic layer, e.g. formed by alkylation or by treatment with organic fluorine compounds. Their specific surface area is preferably in the range of 40 to 400 $m^2/g$.

In preferred embodiments the proportions for fumed metal oxides such as silica ($SiO_2$) and alumina ($Al_2O_3$) incorporated in the particle composition of the toner particles are in the range of 0.1 to 10% by weight.

Fumed silica particles are commercially available under the tradenames AEROSIL and CAB-O-Sil being trade names of Degussa, Frankfurt/M Germany and Cabot Corp. Oxides Division, Boston, Mass., U.S.A. respectively. For example, AEROSIL R972 (tradename) is used which is a fumed hydrophobic silica having a specific surface area of 110 $m^2/g$. The specific surface area can be measured by a method described by Nelsen and Eggertsen in "Determination of Surface Area Adsorption measurements by continuous Flow Method", Analytical Chemistry, Vol. 30, No. 9 (1958) p. 1387–1390.

In addition to the fumed metal oxide, a metal soap e.g. zinc stearate may be present in the toner particle composition.

Instead of dispersing or dissolving (a) flow-improving additive(s) in the resin mass of the toner particle composition they may be mixed with the toner particles, i.e. are used in admixture with the bulk of toner particles. For that purpose zinc stearate has been described in the United Kingdom Patent Specification No. 1,379,252, wherein also reference is made to the use of fluor-containing polymer particles of sub-micron size as flow improving agents. Silica particles that have been made hydrophobic by treatment with organic fluorine compounds for use in combination with toner particles are described in published EP-A 467439.

The toner powder particles according to the present invention are prepared by mixing the above defined binder and ingredients in the melt phase, e.g. using a kneader. The kneaded mass has preferably a temperature in the range of 90 to 140° C., and more preferably in the range of 105 to 120° C. After cooling the solidified mass is crushed, e.g. in a hammer mill and the obtained coarse particles further broken e.g. by a jet mill to obtain sufficiently small particles from which a desired fraction can be separated by sieving, wind sifting, cyclone separation or other classifying technique. The actually used toner particles have preferably an average diameter between 3 and 20 $\mu$m determined versus their average volume, more preferably between 5 and 10 $\mu$m when measured with a COULTER COUNTER (registered trade mark) Model TA II particle size analyzer operating according to the principles of electrolyte displacement in narrow aperture and marketed by COULTER ELECTRONICS Corp. Northwell Drive, Luton, Bedfordshire, LC 33, UK. In said apparatus particles suspended in an electrolyte (e.g. aqueous sodium chloride) are forced through a small aperture, across which an electric current path has been established. The particles passing one-by-one each displace electrolyte in the aperture producing a pulse equal the displaced volume of electrolyte. Thus particle volume response is the basis for said measurement. The average diameter (size) of the toner particles derived from their average volume or weight is given by the instrument (see also ASTM Designation: F 577-83).

Suitable milling and air classification may be obtained when employing a combination apparatus such as the Alpine Fliessbeth-Gegenstrahlmühle (A.G.F.) type 100 as milling means and the Alpine Turboplex Windsichter (A.T.P.) type 50 G.C as air classification means, available from Alpine Process Technology, Ltd., Rivington Road, Whitehouse, Industrial Estate, Runcorn, Cheshire, UK. Another useful apparatus for said purpose is the Alpine Multiplex Zick-Zack Sichter also available from the last mentioned company.

To the obtained toner mass a flow improving agent is added in high speed stirrer, e.g. HENSCHEL FM4 of Thyssen Henschel, 3500 Kassel Germany.

The powder toner particles according to the present invention may be used as mono-component developer, i.e. in the absence of carrier particles but are preferably used in a two-component system comprising carrier particles.

When used in admixture with carrier particles, 2 to 10% by weight of toner particles is present in the whole developer composition. Proper mixing with the carrier particles may be obtained in a tumble mixer.

Suitable carrier particles for use in cascade or magnetic brush development are described e.g. in United Kingdom Patent Specification 1,438,110. For magnetic brush development the carrier particles may be on the basis of ferromagnetic material e.g. steel, nickel, iron beads, ferrites and the like or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 $\mu$m and more preferably in the range of 30 to 100 $\mu$m.

In a particularly interesting embodiment iron carrier beads of a diameter in the range of 50 to 200 $\mu$m coated with a thin skin of iron oxide are used. Carrier particles with spherical shape can be prepared according to a process described in United Kingdom Patent Specification 1,174,571.

The present invention without limiting it thereto is illustrated by the following Example. All ratios, percentages and parts mentioned therein are by weight unless stated otherwise.

EXAMPLE

Preparation of toner I (non-invention toner)

98 parts of polyester P1 of Table 1 were melt-blended for 30 minutes at 110° C. in a laboratory kneader with 2 parts of Cu-phthalocyanine pigment (Colour Index PB 15:3).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle diameter of the separated toner was measured by Coulter Counter model Multisizer (tradename) was found to be 8.3 $\mu$m by volume. In order to improve the flowability of the toner mass the toner particles were mixed with 0.5% of hydrophobic colloidal silica particles (BET-value 130 $m^2/g$).

Preparation of toner II (non-invention toner)

The preparation of non-invention toner II proceeded as described for non-invention toner I with the difference that said polyester P1 was replaced in equal amounts by polyester P3 of Table 1.

Preparation of toner III (invention toner)

49 parts of polyester P1 of Table 1 and 49 parts of polyester P3 of Table 1 (this is mixture 1 of table 2, giving a $D_{excess}$0.50), were melt-blended for 30 minutes at 110° C. in a laboratory kneader with 2 parts of Cu-phthalocyanine pigment (Colour Index PB 15:3).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 $\mu$m by volume.

To improve the flowability of the toner mass the toner particles were mixed with 0.5% of hydrophobic colloidal silica particles (BET-value 130 $m^2/g$).

Each of the above prepared toners I, II and III were used to form carrier-toner developers by mixing said mixture of toner particles and colloidal silica in a 4% ratio with silicone-coated Cu-Zn ferrite carrier particles having an average diameter of 55 $\mu$m.

The thus obtained carrier toner-mixtures were used separately in an X-35 (tradename of Agfa-Gevaert N.V.) electrophotographic copier wherein the photoconductive drum was exposed to a step-wedge original.

From said X-35 copier the standard hot roller fuser was removed, and the toner of the unfixed copy was non-contact fused by radiation using an infra-red black body radiant element placed at a distance of 10 mm from the copy paper carrying the toner image. The copy paper passed-by the radiant element at a speed of 5 cm per second. The average power provided to the radiant heating element was 375 W making the element operate at a temperature of 600° C. using reflectors to concentrate the radiant heat onto the copy paper.

On the fixed toner images gloss measurements were performed at a reflection angle of 60° according to DIN standard No. 67 530 (November 1972) between areas of the same low optical density ($D_1$=0.25) and areas of substantially higher optical density ($D_h$=1.60).

In the following Table 5 the obtained gloss measurement results are mentioned.

TABLE 5

| | Toner I | | Toner II | | Toner III | |
|---|---|---|---|---|---|---|
| | $D_l$ | $D_h$ | $D_l$ | $D_h$ | $D_l$ | $D_h$ |
| Gloss | 14.3 | 30.6 | 7 | 14 | 10.0 | 10.5 |

From the measurement results in said table 5 can be learned that with the invention-toner I almost equal gloss is obtained in the low and high density parts of the fixed toner image, where as with the comparative test toners I and II a substantial difference in gloss between said density values is obtained.

What is claimed is:

1. Dry toner particles comprising a toner resin, wherein:

(i) said toner resin includes a mixture of two polymers A and B, said polymers A and B being chosen such that substantially no phase separation occurs in said mixture when in a molten state, resulting in a transmission density ($D_m$) for an extruded slab of a 50:50 mixture of both polymer A and polymer B with thickness 250 $\mu$m being between 0.3 and 0.7 higher than the sum of half the transmission density of a 250 $\mu$m extruded slab of polymer A alone ($D_A$) and half the transmission density of a 250 $\mu$m extruded slab of polymer B alone ($D_B$), (ii) said polymer A being a polyester and said polymer B being a polyester having a carbonyloxy group content of at least 7.5 mol/kg, (iii) said polymer A and B, included in said toner resin, are mixed in a weight ratio 5:1 to (iv) said mixture of said two polymers A and B makes up at least 25% by weight of said toner resin.

2. Dry toner particles according to claim 1, wherein said mixture of said two polymers A and B makes up at least 75% by weight of said toner resin.

3. Dry toner particles according to claim 1, wherein said toner resin consists of a mixture of said two polymers A and B.

4. Dry toner particles according to claim 1, wherein said polymers A and B are mixed in a weight ratio 3:1 to 1:3.

5. Dry toner particles according to claim 1, wherein said polymers A and B are mixed in a 50:50 ratio by weight.

6. Dry toner particles according to claim 1, wherein both said polymers A and B have a melt viscosity equal to or lower than 10,000 poise (1000 Pas).

7. Dry toner powder according to claim 1, wherein said mixture of said two polymers (A and B) consists of a thermoplastic resin (polymer A) combined with a polymer (polymer B) having a more polar character than said polymer A.

8. Dry toner particles according to claim 7, wherein said polymer A is a polyester with a carbonyloxy group content lower than 5.5 mol/kg.

9. Dry toner particles according to claim 8, wherein said polymer A is a polyester derived from an aliphatic dicarboxylic acid and an alkoxylated 2,2-bis(4-hydroxyphenyl)-propane, and said polymer B is a polyester derived from an aromatic dicarboxylic acid and a diol.

10. Dry toner particles according to claim 9, wherein said diol is ethylene glycol optionally mixed with alkoxylated 2,2-bis(4-hydroxyphenyl)-propane, as long as the ethylene glycol content of the totality of diols is more than 50 mol %.

11. Dry toner particles according to claim 8, wherein said polymer A is a polyester derived from fumaric acid and dipropoxylated 2,2-bis(4-hydroxyphenyl)-propane.

12. Dry toner particles according to claim 11, wherein said polymer B is an aromatic polyester resin derived from terephthalic acid (40 mol %), and isophthalic acid (60 mol %) as aromatic di-acids and a mixture of di-ethoxylated 2,2-bis(4-hydroxphenyl)-propane (40 mol %) and ethylene glycol (60 mol %) as diols.

13. Dry toner particles comprising a toner resin, wherein:

(i) said toner resin includes a mixture of two polymers A and B, said polymers A and B being chosen such that an extruded slab with thickness 250 $\mu$m of a 50:50 mixture of both has a transmission density ($D_M$) being between 0.1 and 1.00 higher than the sum of half the transmission density of a 250 $\mu$m extruded slab of polymer A alone ($D_A$) and half the transmission density of a 250 $\mu$m extruded slab of polymer B alone ($D_B$), (ii) said polymer A being a polyester and said polymer B being a polyester, (iii) said polymers A and B, included in said toner resin, are mixed in a weight ration 5:1 to 1:5 and (iv) said mixture of said two polymers A and B makes up at least 25% by weight of said toner resin, wherein said polymer A is a polyester derived from fumaric acid and di-propoxylated 2,2-bis(4-hydroxyphenyl)-propane, and wherein said polymer B is an aromatic polyester resin derived from terephthalic acid (40 mol %), and isophthalic acid (60 mol %) as aromatic di-acids and a mixture of di-ethoxylated 2,2-bis(4-hydroxyphenyl)-propane (40 mol %) and ethylene glycol (60 mol %) as diols.

* * * * *